United States Patent [19]

Mote, Sr.

[11] Patent Number: 5,025,582

[45] Date of Patent: Jun. 25, 1991

[54] EXTERNAL SAFETY FOR HANDGUN

[76] Inventor: Charles R. Mote, Sr., 1751 N. Camino Altar, Tucson, Ariz. 85743

[21] Appl. No.: 569,299

[22] Filed: Aug. 20, 1990

[51] Int. Cl.[5] ..... F41A 17/54

[52] U.S. Cl. ..... 42/70.06; 42/70.07

[58] Field of Search ..... 42/70.06, 70.07, 70.11

[56] References Cited

U.S. PATENT DOCUMENTS

| | | | |
|---|---|---|---|
| D. 864,940 | 9/1907 | Whittier | 42/70.06 |
| 2,635,380 | 4/1953 | Baker et al. | 42/70.06 |
| 2,657,490 | 11/1953 | Browning | 42/70.07 |
| 2,711,043 | 6/1955 | Bent | 42/70.07 |
| 3,324,587 | 6/1967 | Bryan | 42/70.06 |
| 3,711,979 | 1/1973 | Small | 42/70.07 |
| 3,715,826 | 2/1973 | Seifried | 42/70.06 |
| 4,539,889 | 9/1985 | Glock | 89/147 |

FOREIGN PATENT DOCUMENTS

| | | | |
|---|---|---|---|
| 2744 | 9/1868 | United Kingdom | 42/70.06 |

OTHER PUBLICATIONS

Guns Magazine — Front Cover & Unnumbered Page Showing the Handgun, Also, Articles Starting on p. 24, and 32, Sep. 1990.

*Primary Examiner*—Michael J. Carone
*Attorney, Agent, or Firm*—J. Michael McClanahan

[57] ABSTRACT

An external safety for application to handguns which effectively blocks rearward travel of the trigger to the point where the handgun is discharged, the external safety consisting of a trigger block adapted to be pivoted into the path of the trigger, and out of the path of the trigger as desired, by attached levers accessible to the operator. The trigger block and levers are secured upon the handle of the handgun by a pair of brackets operably attached to the handgun handle proximate the trigger and trigger guard. The brackets are situated on opposite sides of the handgun to pivotally receive the trigger block and lever assembly permitting it to be pivoted into the trigger blocking configuration or out of the trigger blocking configuration.

15 Claims, 12 Drawing Sheets

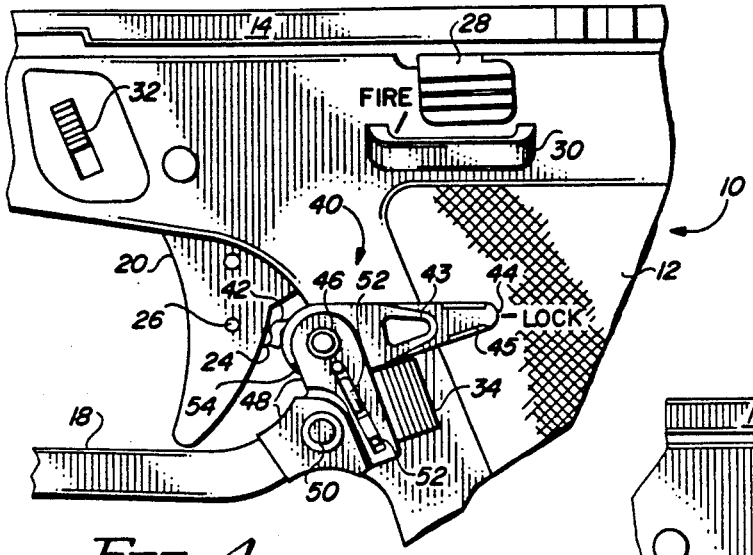
FIG. 4
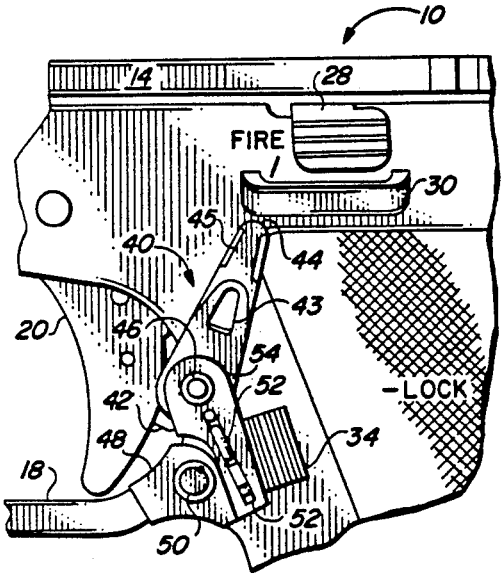
FIG. 5
FIG. 8
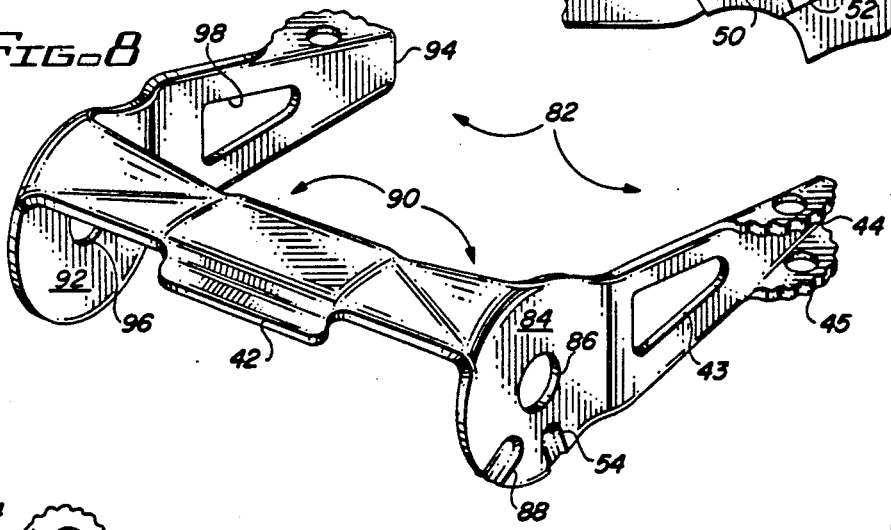
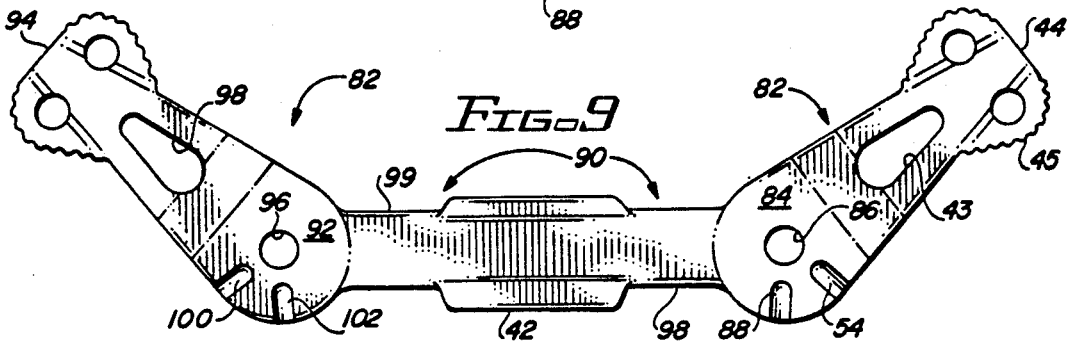
FIG. 9

EXTERNAL SAFETY FOR HANDGUN

BACKGROUND OF THE INVENTION

1. Field of the Invention

The field of the invention is safeties for handguns, both automatic and revolver, installed externally upon the handgun frame.

2. Description of the Related Art

It is very important that there be safety devices on guns, both handguns and rifles, to prevent their accidental firing. However, of the two, it is perhaps the handgun where safeties are most important because practically the only method of carrying a handgun is in one's hand, and certainly the only comfortable method is to grasp the handgun as one would use it to shoot, i.e., with a finger within the trigger guard. A riffle may be grasped and carried by merely holding the stock of the rifle without having one's finger on the trigger or within the encircling trigger guard found both on rifles and handguns.

There are various type of safeties on handguns. On automatics, i.e., a handgun employing a slide mounted upon a frame, the slide travels to the rear (relative to the frame) to eject a spent cartridge and then returns to load a fresh bullet into the firing chamber, internal and external safeties has been manufactured into the handgun. Most of these safeties have been internal type safeties wherein the hammer (concealed within the handgun frame and slide) is physically interrupted by a mechanical device to inhibit travel of that hammer. This mechanical device may be actuated by a push button protruding through the outside surface of the frame or, perhaps, by a suitable boss protruding outwardly from the surface of the handle which may be slide operated by a finger.

Other methods have been utilized such as that employed in the Glock brand handguns wherein the trigger itself has a safety trigger riding within a longitudinal slot formed in the main trigger. Here, the operator's finger must be securely upon the primary or main trigger as well as upon the safety trigger in order to release a catch mechanism operably attached to the safety trigger. In addition, as is common in many automatic handguns, a safety working with the slide of the handgun may be present. In these cases, the slide may be placed into a locked position such that in order to make the handgun fireable, the trigger must be pulled, the slide fully retracted and then permitted to go forward. The trigger must then be released and then pulled again before the handgun will fire.

In revolver type handguns, where the hammer is readily visible on the frame, a safely is employed whereby the hammer may be retracted a small portion of its full movement to the rear where it latches with the safety mechanism. At that point, the trigger itself may not be pulled rearward to fire at all. To fire the revolver, a hand movement of the hammer must be made to retract the hammer to its farthest rotated position where it is held. Then when the trigger is pulled, the hammer will proceed to pivot forward to discharge the cartridge held in the chamber.

Since the Glock automatic handgun has been on the market for the last few years or so, there has been extremely high interest in this pistol, especially in the 9 mm version. It has been adopted by many police forces, and to some extent by the military. However, the handgun is alleged by many to suffer from deficiencies in that the safety mechanisms upon the gun to prevent accidental discharge are inadequate. There is much controversy over this issue. In support of the handgun, the Glock does have the safety trigger mentioned above functioning with its main trigger as one safety mechanism, and it does employ an internal safety mechanism as well.

Nevertheless, there have been accidental discharges of the Glock handgun which have resulted in numerous articles questioning whether the safeties provided on the handgun are sufficient. For example, the September 1990 issue of GUNS Magazine had a special report upon the Glock handgun and in that report had an article in which it was stated that since there is no safety latch to keep the trigger from being pressed back, it is imperative that the Glock be carried in a holster that covers the trigger and trigger guard.

The need for an external safety upon the Glock handgun, as well as other automatic and revolver type handguns, to prevent accidental firing is obvious. An external safety which physically interrupts the backward movement of the trigger will prevent accidental firing and it is to this need this invention is directed.

Accordingly, it is readily apparent that the safe handling of handguns is enhanced if handguns, both automatics and revolvers, have an external safely which physically impedes the pulling of the trigger.

It is also obvious that in some handguns there is need for apparatus which physically impedes the movement of the trigger to prevent an accidental discharge of the gun or to prevent any suggestion of accidental discharge.

SUMMARY OF THE INVENTION

The embodiment of the invention described consists of a mechanism externally applied to a handgun adapted to selectively inhibit the travel of the trigger in the handgun to prevent accidental discharge. The apparatus which when placed in a lock or safe position, pivots a trigger block into position behind the trigger such that the trigger movement does not progress rearward to the point where the handgun is discharged. The trigger block may then be rotated out of position and when accomplished, the trigger is free to travel its full range or sufficient range to discharge the cartridge held in the chamber.

In construction, the invention consists of a pair of bracket assemblies adapted to be secured to the handgun frame, and in particular to the frame in and about the area where the lower part of the trigger guard (which surrounds the trigger) joins to the handle of the frame. Two brackets are employed, one on either side of the frame, which are secured to the frame by a rivet passing through the handgun frame at a non-strategic position. Each bracket extends upward from its point of attachment along the side of the handgun frame to provide a pivotal opening about which a trigger block and lever assembly may rotate. The trigger block and lever assembly consists of a mechanical "U" shaped structure having the parallel legs of the "U" which comprise the levers and having in the center portion the trigger block. The angle of the legs to the center portion is 90 degrees. On opposite ends of the legs joining the center portion are circular flanges having a centrally located opening adapted to mate when assembled with the openings in the bracket assembly. Into each of the mated openings on opposite sides of the frame, pivot pins are placed, these pins comprising rivets. The fabrication and construction of the trigger block and lever assembly, as well as the bracket assembly, is carefully accomplished to insure dimensional accuracy in order that the purposes of the invention be accomplished, i.e., the trigger movement to the rear be terminated before the trigger reaches the point that the handgun discharges.

To properly position the trigger block behind the trigger, either in the lock (safe) position, or in the fire position and to hold it there, a pair of detents, nominally 60 degrees of arc apart, are formed in the circular flange portion of each leg of the trigger block and lever assembly. Forcibly riding upon the circular flanges adapted to engage these detents is a detent spring which is securely held by each of the brackets against the handle of the frame of the handgun. A downward curved portion of the detent spring forcibly engages the grooves defining the lock and fire detents.

In use, the levers of the trigger block and lever assembly are rotated to a point to where the detent spring engages one or the other of the two detents at which time the trigger block and lever assembly effectively stops rotating. If the lever is rotated to the lock (safe) position, the trigger block is immediately behind the trigger of the handgun and prohibits the trigger from moving backwards sufficiently to discharge the handgun. The downwardly curved portion of the detent spring is then residing in the lock detent. If the lever of the trigger block and lever assembly is rotated to the fire position, the leg rotates around the pivot point (opening in the annular flange) to the position where the detent spring engages the fire detent and at that point, the trigger block has rotated out of position blocking the backward movement of the trigger such that the trigger may now be pulled sufficiently rearwardly to discharge the firearm. The trigger block is still behind the trigger of the handgun and within the trigger guard, however, it is not blocking the trigger's travel early enough to prevent discharge of the handgun.

If desired, the two positions which the lever takes when its detents are engaged by the detent springs may be alternately marked "LOCK" and "FIRE" or, a dot of bright paint may be placed upon the handgun frame in such a strategic position that the dot is covered by the lever when the lever is in the LOCK position. Moving the lever to the FIRE position will uncover that dot of bright paint and thus inform the operator the safety is no longer engaged.

Accordingly, it is an object of the subject invention to provide an external safety for handguns which impedes the backward movement of the handgun trigger sufficient to prevent discharge the handgun.

It is another object of the subject invention to provide an external safety for handguns having a trigger block to block backward movement of the trigger, which trigger block may also be rotated out of place for discharge of the handgun.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein:

FIG. 4 is an enlarged partial side view of the handgun with the inventive external safety installed and in a lock position;

FIG. 5. is an enlarged partial side view of the handgun with the inventive external safety installed and in a fire position;

FIG. 8. is a perspective view of the trigger block and lever assembly utilized in the invention;

FIG. 9. is a top view of the trigger block and lever assembly after fabrication but before being formed to the configuration shown in FIG. 8.

In various views, like index numbers refer to like elements.

DETAILED DESCRIPTION OF THE PREFERRED EMBODIMENT

Figure 1:
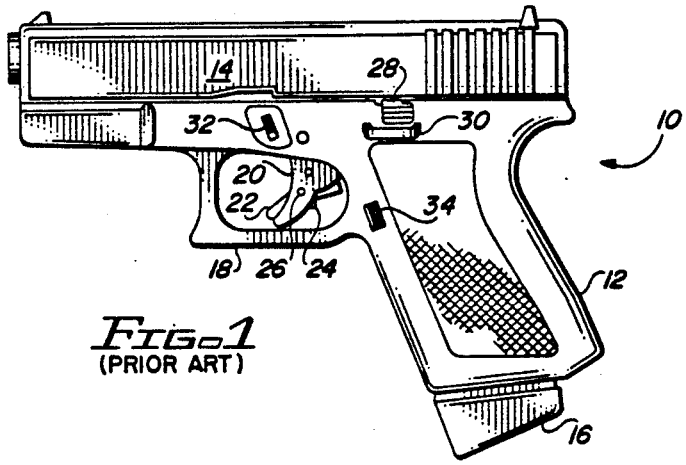
FIG. 1 (PRIOR ART)
FIG. 1. is a side view of a handgun to which the inventive external safety is to be added.

Referring now to FIG. 1, shown is a side view of an automatic pistol or handgun 10 upon which the inventive external safety is to be installed. More particularly, here shown is the Glock Model 19. Various parts of automatic handgun 10 are identified as follows. Frame 12 is that part of the handgun which a person holds in the palm of their hand which includes the handle. It receives magazine 16 internally to the handle which magazine holds bullets to be shot. A small portion of the magazine is seen in FIG. 1. Trigger guard 18 attaches at its lower part to the handle of frame 12 and attaches at its upper part to the upper portion of frame 12. It surrounds and encompasses main trigger 20. In the handgun shown in FIG. 1, a second trigger, namely safety trigger 22, requires that to fire the handgun, it be pulled simultaneously with main trigger 20. Safety trigger 22 pivotally resides within a longitudinal slot formed in main trigger 20. Safety trigger 22 shown in the diagram rotates about pivot 26. Immediately behind and attached to the back part of main trigger 20 is dimple 24. This is a half moon shaped protrusion attached to the back side of the main trigger which is the part of the main trigger which will be engaged by the invention to prevent firing. It is realized of course that the invention could easily be fashioned to engaged other points on the rear side of the trigger.

Immediately above frame 12 and supported by frame 12 is slide 14, that portion of the handgun which encloses and secures the barrel (seen emerging from the front end of the handgun), as well as its attached chamber (not shown) holding the bullet during firing. After firing, slide 14 moves to the rear under the effect of the rapidly expanding gases generated by detonating the gun power held in the bullet cartridge. At or near the time the slide reaches its maximum rearward movement position, the spent cartridge is ejected (from the portion of the slide opposite that shown in FIG. 1). Upon the slide's return, a new bullet is taken from the magazine and loaded into the chamber. Additionally shown in FIG. 1 is slide lock 28 and its guard 30. The release for disassembly (of the slide from the frame) is shown as numeral 32. Lastly, magazine release 34 is shown immediately behind trigger guard 18.

Figure 2:
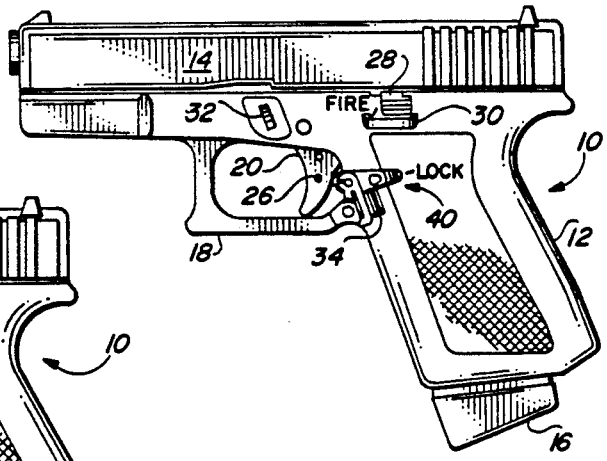
FIG. 2. is a side view of the handgun shown in FIG. 1 with the external safely mounted upon the handgun and in a lock position.

FIG. 2 shows a side view of the subject inventive external safety mounted to the handle of frame 12 of handgun 10, and, as shown by the nomenclature printed upon the handgun, is in the LOCK or safe position. It is noted firstly, in comparing the relative position of the trigger in FIG. 2 with the position of the trigger in FIG. 1, trigger 20 has been pulled to the rear to the point where its travel is blocked by external safety 40 such that the handgun will not fire. Thus, the action of external safety 40 is to inhibit the full travel of the main trigger necessary to fire the handgun. It is noted that safety trigger 22 spoken of in connection with FIG. 1 has pivoted around pivot pin 26 so that it is completely enclosed within the longitudinal slot formed in the main trigger and is not visible in FIG. 2.

Figure 3:
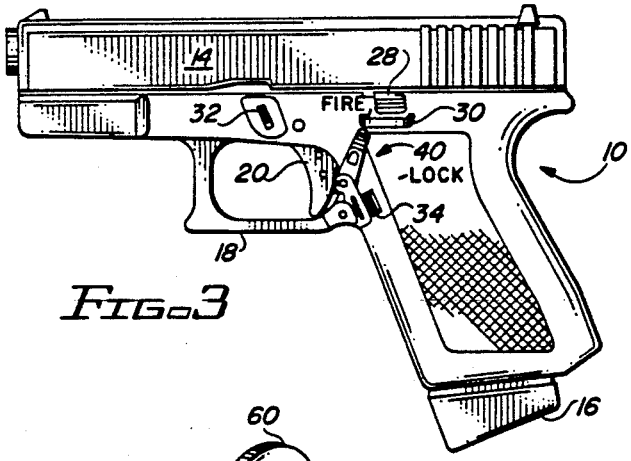
FIG. 3. is a side view of the handgun shown in FIG. 1 with the subject inventive external safety mounted upon the handgun and in a fire position.

Referring now to FIG. 3, a side view of the same automatic handgun 10 is shown with external safely 40 now in the FIRE position whereupon, in comparing the trigger positions of FIGS. 2 and 3, main trigger 20 has now traveled and additional distance and is sufficiently back to allow the handgun to fire. Thus, by rotation of the shown lever of external safety 40 from the LOCK position to the FIRE position, that portion of the external trigger 40 which inhibited further travel of main trigger 20 has been rotated out of the way so that main trigger 20 may go fully to the rear as required for firing the handgun.

More detailed drawings of the external safety 40 is shown in following FIGS. 4–10.

FIG. 4 is an enlarged side view of a portion of frame 12 showing external safety 40 mounted upon the handle proximate the rear of main trigger 20. More particularly, lever 44 of external safety 40 is shown in the LOCK or safe position (handgun not able to fire) whereupon trigger block 42 attached to lever 44 is engaging dimple 24 of main trigger 20 to prevent movement of main trigger 20 further to the rear to fire the handgun. It is noted that trigger block 42 is also engaging the rear portion of the trigger opening of the handle. By this manner, additional resistance to further trigger movement is provided. Lever 44 and connected trigger block 42 rotate around pivot pin 46. Pin 46 is held by bracket 48, bracket 48 comprising one of two mirror image brackets comprising the bracket assembly which is fixedly attached to the handle of frame 12 by rivet 50 at or near its junction with the lower part of trigger guard 18. In order to retain lever 44 in either the LOCK or FIRE position, two detents (not shown) are formed in an annular flange to which lever 44 is connected wherein a central opening (not shown) in the annular flange allows passage of pivot pin 46. These detents, which are separated by an arc 60 degrees apart, are alternately engaged by detent spring 52 shown residing in a slot formed in bracket 48. Each of the elements which make up external safety 40 are shown separately and in a much expanded view in FIGS. 6–10. Shown on lever 44 of external safety 40 are the turned up sides 45 to facilitate the person's grip upon the lever when it is desired to be moved, as well as opening 43 which permits the removal of dirt or other particles which may come between the bottom surface of lever 44 and the external surface of the handgun 10.

Referring now to FIG. 5, external safety 40 has now been rotated by 60 degrees to the FIRE position. It is noted that trigger block 42 has now moved out of position directly behind main trigger 20 where it engaged dimple 24 (FIG. 4) and main trigger 20 has now moved sufficiently far to the rear that the handgun fires. In this position, lock detent 54 formed on the annular flange connected to lever 44 is just beginning to show underneath bracket 48. At this position, the fire detent (not shown) is now under and is engaged by detent spring 52. By the engaging of the detent spring 52 in the respective lock and fire detents, the position of lever 44 in either the lock or fire configuration is maintained against accidental movement.

It has been noted by the inventor that for the particular handgun, i.e., Glock model 19, external safety 40 interrupts the main trigger 20 at a position where the top most part of dimple 24 is approximately 0.230 inches from the closest point of the rear portion of the trigger opening (of which trigger guard 18 forms a part). The handgun fires when this distance has been reduced to approximately 0.144 inches. Accordingly, the inventive external safety allows a safety gap distance of approximately 0.086 inches, which is well in front of the firing point at 0.144 inches. Thus, adequate allowances are made for any variations that might appear from handgun to handgun.

Figure 6:
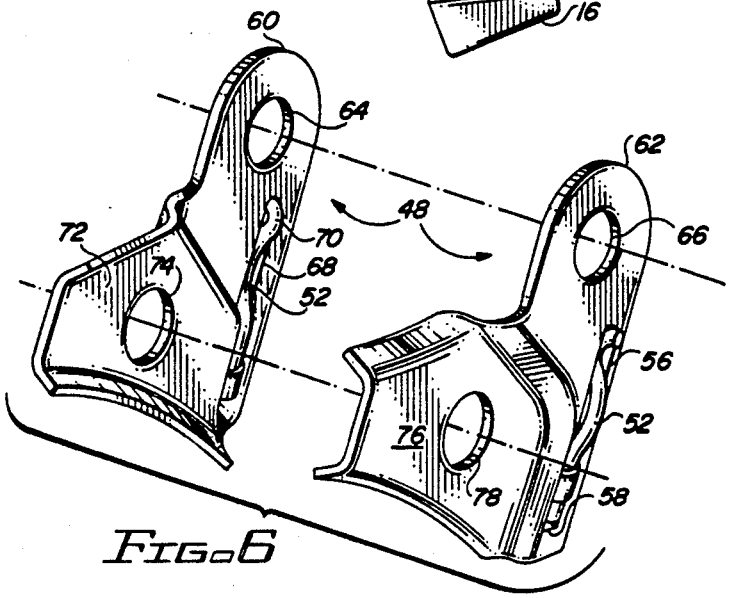
FIG. 6. is an exploded perspective view of the left and right brackets of the bracket assembly of the invention which are to be installed on the frame of the handgun.

Referring now to FIG. 6, a view of the brackets of the bracket assembly 48 portion of external safety 40 is shown in a exploded perspective view wherein the two brackets have been aligned as if they were mounted on the handle and trigger guard portions of the handgun frame. Also shown in FIG. 6 are the two detent springs 52 mounted within the two openings 56 and 68 of the two brackets 62 and 60 respectively. More specifically, bracket assembly 48 comprise left bracket 60 and right bracket 62. At the top end of each of the brackets is lever pivot openings 64 and 66 through which pivot pins 46 shown in FIGS. 4 and 5 pass and are held. Obviously, two pivot pins 46 will be utilized, one on each side. Pivot pins 46 does not pass through the handgun. Immediately below pivot opening 66 in right bracket 62 is detent spring openings 56 and 58 which secure detent spring 52 which engages the detents in lever 44. By use of the two openings 56 and 58, and a pocket formed in the lower part of opening 58, detent spring 52 is held against the annular flange without touching the handgun handle and without the need of other external fasteners. It is noted that a portion of the bracket passes over detent spring 52, i.e., that portion situated between openings 56 and 58. Detent spring 52 is so formed that it rises up partially out of opening 56 as shown and then detent spring 52 curves downward near the top end of opening 56 to form the downwardly curved portion that actually engages the detent formed in the annular flange connected to lever 44.

Referring now to left bracket 60, immediately below level pivot opening 64 which will receive the second pivot pin 46 is seen detent spring 52 partially in opening 68 with a portion of detent spring 52 protruding outward from bracket 60. Numeral 70 designates the actual portion (downwardly curved portion) of the detent spring which engages the detents of the annular flange attached to lever 44.

It is noted that both brackets 60 and 62 generally conforms to the shape of the handgun in the area in which the bracket is adapted to cover. On bracket 60, lower portion 72 is stepped inwardly from the upper portion of bracket 60 as lower portion 72 partially encircles the beginning of trigger guard 18. Centrally located in the bracket lower portion is opening 74 to receive rivet 50 (FIGS. 4 and 5) which holds the two brackets to the handgun. it is noted at this point that it will be necessary to drill a hole through the trigger guard portion of the handle of the Glock type handgun to allow passage of rivet 50.

With respect to right bracket 62, seen is the mirror image of left bracket 60 with the bracket lower portion 76 stepped inwardly from the upper portion, also to partially enclose a portion of trigger guard 18. Centrally located in the bracket lower portion is opening 78 adapted to receive rivet 50 to secure both left and right brackets in place on the handle of frame 12.

Figure 7:
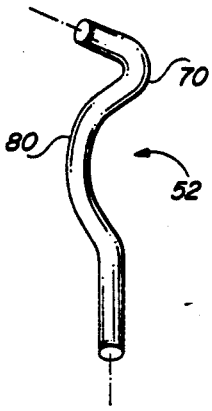
FIG. 7. is a perspective view of the detent spring utilized in the invention.

FIG. 7 is a perspective view of detent spring 52 showing, at the top end, the curve or turned down portion 70 which actually engages the detents formed in the flange of the trigger block and lever assembly as well as the central protruding portion 80 which rises up above the opening formed in each of the brackets to help secure detent spring 52 in place. The lower portion of detent spring 52 shown in FIG. 7 dives under the bridge formed between the two openings in the bracket to emerge into the lower opening of the bracket. A separate detent spring 52 is utilized in each of the brackets.

FIG. 8 is a perspective view of the formed trigger block and lever assembly showing the pair of spaced apart levers, the flanges attached to one end of each of the levers, and the elongated trigger block attached to the flanges at the ends of the levers. Trigger block and lever assembly 82 resides on opposite sides of the handle of the handgun and is secured in place by pivot pins 46 attached to the brackets. It is noted that although the two pivotal openings in the trigger block and lever assembly are aligned, two pivot pins 46 are utilized. In the preferred embodiment, rivets which allowed rotation of the trigger block and lever assembly were actually used.

More particularly, trigger block and lever assembly 82 shown in FIG. 8 comprises firstly lever 44 attached to annular flange 84, which flange was centrally located opening 86 to receive pivot pin 46 (FIGS. 4 and 5). In a lower portion of annular flange 84 is the two detents formed into the flange, namely lock detent 54 previously discussed and fire detent 88. In the preferred embodiment, lock detent 54 is slightly deeper than fire detent 88 so that it requires more force by the operator to rotate lever 44 from the lock position to the fire position than it requires to rotate from the fire position to the lock position. Both detents are formed by coining in the single stamping from which the trigger block and lever assembly 82 is made. At the end of lever 44 are upturned sides 45 and opening 43 previously discussed.

Attached to annular flange 84 is bridge 90 which connects it with annular flange 92 of the left lever 94. In bridge 90 is formed trigger block 42 which takes the cross sectional shape as is illustrated in FIG. 9. The length of trigger block 42 is sufficient to cross entirely the width of the main trigger 20. Webs on either side span the distance between trigger block 42 and both the annular flanges. Thus, bridge 90 spans the distance between the left and right levers and their associated annular flanges with centrally situated trigger block 42 and on both sides of trigger block 42 a web connecting to the annular flanges. This is all shown in FIG. 9. Continuing, on the left hand portion of FIG. 8 is annular flange 92 with its centrally located opening 96 which is in alignment with the corresponding opening 86 in flange 84. Lastly, connected to annular flange 92 is left lever 94 which is a mirror image of right lever 44. Formed in the outside edge of left lever 94 are the upturned sides corresponding with upturned sides 45 of right lever 44. Also seen is opening 98 which allows for the cleaning of the frame below lever 94.

As shown in FIG. 8, both left and right levers 94 and 44 respectively are bent or stepped near the junction of the levers with their connected annular flanges to conform to the sides of the handgun.

FIG. 9 is a top view of the trigger block and lever assembly 82 laid out in a flat plane after stamping (or cutting) and prior to forming. As is readily seen, bridge 90 which connects annular flange 84 with annular flange 92 includes central trigger block 42 together with webs 98 and 99 between trigger block 42 and the annular flanges. All the elements of the trigger block and lever assembly 82 are shown in FIG. 9, and in addition, the detents formed on annular flange 92 not seen in FIG. 8 are shown as lock detent 100 and fire detent 102. As was the case in the lock and fire detents situated in annular flange 84, in the preferred embodiment, lock detent 100 is coined to slightly more depth than fire detent 102. The trigger block and lever assembly 82 shown in FIG. 9 is fabricated in a progressive stamping die to result with the formed shape shown in FIG. 8 to the point where the levers and annular flanges are parallel and openings 86 and 96 in alignment. Further, trigger block 42 is at right angles to the longitudinal direction of levers 44 and 94.

Figure 10:
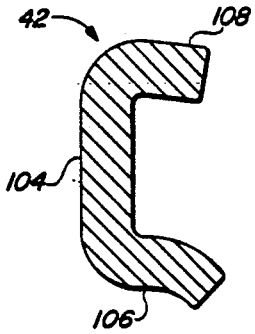
FIG. 10. is a cross sectional view taken in the center of the trigger block of the trigger block and lever assembly which intersects the trigger of the handgun.

The central part of bridge 90, namely trigger block 42, has a modified "C" shaped cross section as shown in FIG. 10. Trigger block 42 shown in FIG. 10 is comprised of a series of various curved and slightly curved surfaces. The surface at the lower part of trigger block 42, namely lower curved surface 106, engages dimple 24 on the back side of the main trigger 20 as shown in FIG. 4 when the external safety is in the lock position and upper curved surface 108 is just touching the back position of the trigger opening of the handgun handle. As trigger block and lever assembly 42 is rotated to where the lever 44 is at the safe position, trigger block 42 is similarly rotated out of the way of main trigger 20 and its dimple 24 as shown in FIG. 5. When in the safe position, trigger block 42 has been rotated to the point where the central flat or slightly curved surface 104 is now proximate the back side of main trigger 20 and dimple 24 attached to main trigger 20 is slightly above end curved surface 108.

It is realized of course that the exact curved surface of the trigger block 42 shown in FIG. 10 may be varied. The whole intent is that trigger block 42 in the lock position does place a stop to backward travel of the handgun trigger and when the trigger block and lever assembly is rotated to fire position, it rotates the trigger block out of the way behind the trigger so that the trigger may complete its travel to fire the handgun.

In the drawings which have been shown in connection with the external safely, positions of LOCK and FIRE have been shown by lettering upon the handgun and a line to which the lever is aligned. In the preferred embodiment, a bright spot, perhaps of color red or yellow, will be painted upon the handle such that when the lever is in the lock position, the dot of color will be covered. Conversely, when the lever is in the fire position, the dot will be uncovered so that it may be seen very easily.

In the preferred embodiment, the trigger block and lever assembly, as well as each of the brackets, were formed from flat pieces of metal, preferably either stainless steel or titanium. The parts were produced with progressive dies. The detent spring was formed from 0.035 inch diameter, heat treated music wire, or stamped from beryllium copper.

While it is realized that the bracket assembly shown in the invention was attached to the handguns by means of a rivet passing through the body of the frame of the handgun, it is apparent that it is well within the engineering art to use other methods to secure the bracket assembly to the handgun frame. Not the least of these methods would include utilizing an adhesive, or modifying the brackets to include a clamp which will wrap around the trigger guard to be secured there. The method chosed in the preferred embodiment, that of placing a rivet through the handgun, was deemed the simplest method for the particular handgun the element of the invention were designed to fit. Other shaped handguns will of course require modifications to the brackets, and to the trigger block and lever assembly in terms of their ultimate shape, but not function.

While a preferred embodiment of the invention has been shown and described, it will be appreciated that there is no intent to limit the invention by such disclosure. Rather, the disclosure is intended to cover all modifications and alternate embodiments falling within the spirit and the scope of the invention as defined in the appended claims.

I claim:

1. On a handgun having a frame, the frame consisting of a handle and trigger guard, the trigger guard attached at one point to the handle, the trigger guard defining in part a trigger opening, a trigger situated interiorly to the trigger opening, the trigger adapted to be moved rearward towards the rear portion of the trigger opening to fire the handgun, an external safety for the handgun comprising:

a trigger block operably situated behind the trigger of the handgun:

a pair of levers operably attached to said trigger block; and a pair of brackets operably attached to said pair of levers and to the handgun frame whereby either one of said pair of levers may be operated for operation of the external safety.

2. The external safety for the handgun as defined in claim 1 wherein each one of said pair of levers has two ends, one end of which defines a flange, said flange of one of each of said levers operably attached to one each of said pair of brackets.

3. The external safety for the handgun as defined in claim 2 wherein said flange of each one of said levers is pivotally attached to one each of said brackets whereby said pair of levers may be pivotally rotated to positions.

4. The external safety for the handgun as defined in claim 3 wherein said trigger block defines an elongated structure having two ends with a modified "C" shaped cross-section centrally located in said elongated structure.

5. The external safety for the handgun as defined in claim 4 wherein one each of said trigger block elongated structure two ends is attached to one each of said pair of levers.

6. The external safety for the handgun as defined in claim 5 wherein said trigger block situated behind the trigger of the handgun is situated between the trigger of the handgun and the rear portion of the trigger opening.

7. The external safety for the handgun as defined in claim 6 wherien said pair of brackets operably attached to the handgun is attached to the handgun trigger guard.

8. The external safety for the handgun as defined in claim 7 wherein said pair of brackets is spaced apart and encompasses the handgun trigger guard therebetween.

9. The external safety for the handgund as defined in claim 8 wherein each of said pair of brackets includes an opening and each said flange includes an opening, each said brackets opening and each said flange opening being the pivotal point of each of said pair of levers, said flange opening proximate one of each said ends of said levers attached to said trigger block whereby either one of said pair of levers may be operated to pivotally move said trigger block operably situated behind the trigger of the handgun.

10. The external safety for the handgun as defined in claim 9 further including a pair of detent springs, one each of said detent springs operably attached to one each of said pair of brackets.

11. The external safety for the handgun as defined in claim 10 wherein each said flange includes a pair of detents, one of said detents defining a fire detent and the other said detents defining a safe detent, each of said detents of each said flange adapted to be engaged by one each of said detent springs whereby said safe detent is engaged by said detent springs when said pair of levers is rotated to a safe position and said fire detent is engaged by said detent springs when said pair of levers is rotated to a fire position.

12. The external safety for the handgun as defined in claim 11 wherein said modified "C" shaped cross-section of said trigger block includes and upper curved surface, a lower curved surface, and a central flat surface, said lower curved surface engaged by the handgun trigger and said upper curved surface engaging the back portion of the trigger portion when said pair of levers have been rotated to the safe position whereby the handgun trigger is blocked by said trigger block and may be be moved sufficiently rearward to fire the handgun.

13. The external safety for the handgun as defined in claim 12 wherein said trigger block modified "C" shaped cross-section central flat surface is non-touchably situated behind the handgun trigger when said pair of levers is rotated to the fire position whereby the handgun trigger is not blocked by said trigger and the trigger may be pulled rearwardly sufficient to fire the handgun.

14. The external safety for the handgun as defined in claim 8 further including a rievet, said rivet attaching said pair of brackets to the handgun trigger guard.

15. The external safety for the handgun as defined in claim 9 further including a pair of rivets, one each of said pair of rivets passing through said opening of each said brackets and said flange whereby said pair of levers may pivot about said pair of rivets.

* * * * *